United States Patent [19]

Bott

[11] Patent Number: 4,805,913

[45] Date of Patent: Feb. 21, 1989

[54] DEVICE FOR DEVELOPING GOLF BALL ADDRESS STANCE

[76] Inventor: Roger L. Bott, 3330 57th Ave., Vero Beach, Fla. 32960

[21] Appl. No.: 96,769

[22] Filed: Sep. 11, 1987

Related U.S. Application Data

[63] Continuation of Ser. No. 878,781, Jun. 26, 1986, abandoned.

[51] Int. Cl.[4] ..... A63B 69/36

[52] U.S. Cl. ..... 273/187 R; 273/DIG. 30; 273/200 B; 273/186 C

[58] Field of Search ..... 273/187 R, 187 A, 187 B, 273/183 A, 184 R, 184 B, 185 R, 185 A, 185 C, 186 C

[56] References Cited

U.S. PATENT DOCUMENTS

| | | | |
|---|---|---|---|
| 1,484,390 | 2/1924 | Gibbs et al. | 273/187 R |
| 2,777,697 | 1/1957 | Crossot | 273/187 A |
| 3,350,101 | 10/1967 | Bishop et al. | 273/186 R |
| 3,408,750 | 11/1968 | McCollough et al. | 273/187 R |
| 3,542,369 | 11/1970 | Anderson | 273/186 R |
| 3,580,584 | 5/1971 | Trosko | 273/187 R |
| 3,658,344 | 4/1972 | Kimble | 273/187 R |
| 4,000,905 | 1/1977 | Shirhall | 273/187 A |
| 4,023,810 | 5/1977 | Lorang | 273/186 C |
| 4,101,130 | 7/1978 | Richards | 273/187 A |
| 4,164,352 | 8/1979 | O'Brien | 273/187 A |
| 4,248,431 | 2/1981 | Burnes | 273/187 R |

FOREIGN PATENT DOCUMENTS

| | | | |
|---|---|---|---|
| 383767 | 11/1932 | United Kingdom | 273/186 R |

*Primary Examiner*—George J. Marlo

*Attorney, Agent, or Firm*—Jones, Day, Reavis & Pogue

[57] ABSTRACT

A golf teaching, training and practice device is provided which comprises in combination: a mat, at least one removably attachable or adhesive foot silhouette which is attachable to said mat for the alignment of at least one of a golfer's feet, a precision stance placement grid on said mat comprising vertical and horizontal perception lines, and a swing path on said mat. Optionally included are additional foot silhouettes, an extended swing path and a removably attachable or adhesive golf ball image. This device, when used in conjunction with proper exercising will program the subconscious memory to achieve a proper and reproducible address and stance for a precision swing.

1 Claim, 1 Drawing Sheet

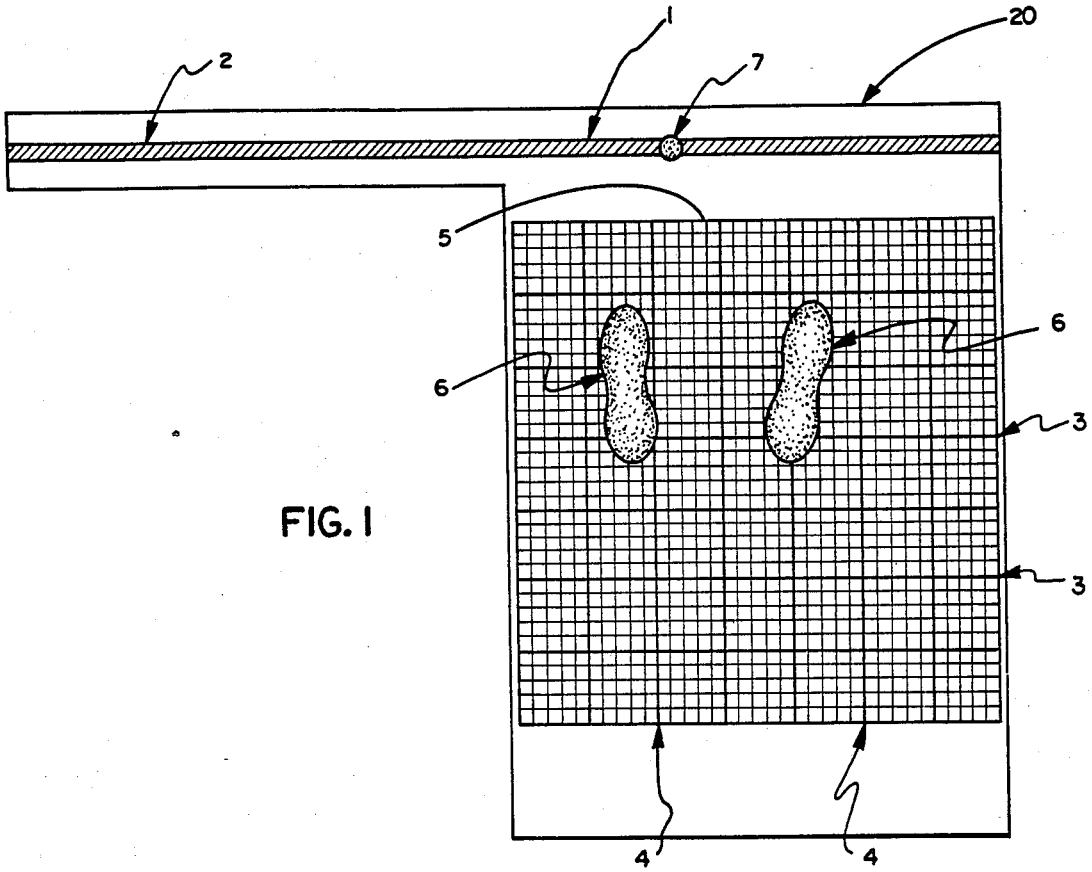
FIG. 1
FIG. 2
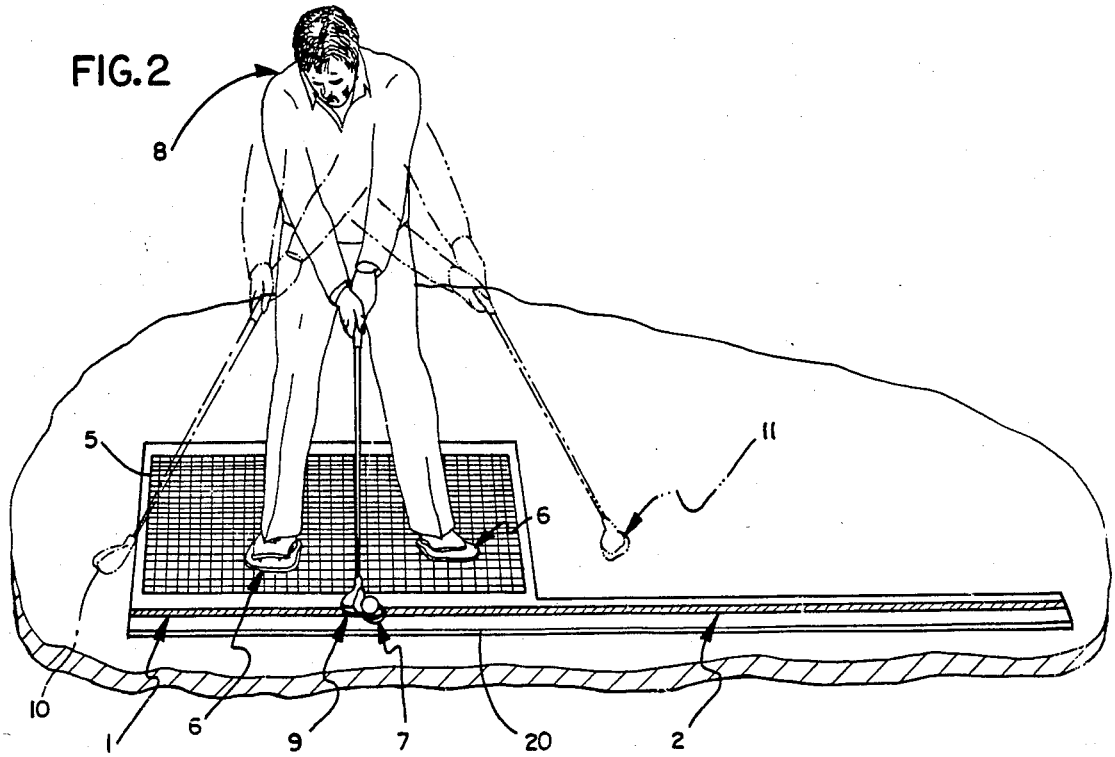

DEVICE FOR DEVELOPING GOLF BALL ADDRESS STANCE

This is a continuation of application Ser. No. 878,781 filed on June 26, 1986, now abandoned.

BACKGROUND OF THE INVENTION

1. Field of the Invention

The present invention relates to a teaching, training, and practice device to assist golfers in developing a proper precision stance and address of the golf ball.

2. Description of the Prior Art

The only two obstacles between a golfer and perfection of his game are distance and direction. The greatest swing in the world cannot possibly hit a good shot if the alignment is not correct. On the other hand, a mediocre swing that is aimed at the target has a good chance of success. Even a topped shot will probably go straight.

Muscle alignment, including alignment of the muscles in the legs, hips, upper torso and arms, arising out of the proper stance and proper address of the ball is the most important physical aspect of the game of golf. While individual players have particular idiosyncrasies in their address and their stance, certain necessary requirements must be fulfilled to achieve a proper golf stroke that sends the ball a sufficient distance in the proper direction. One of the most important of these requirement is the proper placement of the feet relative to the placement of the golf ball and relative to the direction of intended travel of the ball.

Moreover, it is desired to develop muscles to provide a reproducible golf swing that is consistent from golf shot to golf shot. Only with extensive practice can such desired consistency and precision be attained. The device of the present invention assists in the development of this consistency when utilized in a proper training routine. There are numerous prior art golf training devices that purport to obtain the results achieved by the device of the present invention, discussed more fully below. However, as will be seen, none of those devices achieves the results Provided by the present invention.

The United States Patent to Burnes (U.S. Pat. No. 4,248,431) purports to describe a golfing aid which includes a base mat having a target line, an approach line, an address mat which is adjustable in a direction toward and away from the ball position, and a pair of foot mats adjustably positioned for addressing the ball in various stances. The Burns device, however, is a complex mechanical device involving overlapping mats slidably connected for establishing the relative positions of the feet with respect to the golf ball. As a result of its complex structure, it is confusing to use in practical golf instruction and practice situations.

The Patent to Shirhall (U.S. Pat. No. 4,000,905) describes a golf mat on which are indicated positions and angles for the feet, placement of the ball and guidelines to indicate the proper direction to be traversed by the club. However, while being comprised of a series of lines for the alignment of clubs, ball placement, and foot placement, it has no removably attachable foot silhouettes to assist the golfer in reproducibly placing his feet in a proper stance. Moreover, the series of lines presented on the mat in Shirhall, are overly complex and confusing to the average golfer.

The Patent to Richards (U.S. Pat. No. 4,101,130) describes a golf mat containing cut out portions delineating the positions of he feet and including markings of length and golf club types to attempt to position the golf ball with respect to the golfer. As can be readily seen in the Richards patent, the cutout portions for the feet cannot be adjusted for individual shots or individual styles, nor is there an accurate means of placing the ball relative to the mat.

The Patent to Anderson (U.S. Pat. No. 3,542,369) purports to describe a practice mat made of felted sisal fibers which contains a tee, indicia designating the proper position of the golfer's feet, the direction of the target, and the path that the head of the club should follow in driving the ball. However, the patent to Anderson fails to disclose the necessity of a removably attachable foot silhouettes to assist the golfer in aligning stance relative to the ball, nor does it suggest how such a result could be accomplished.

Several other patents, notably the U.S. Patents to Crossot (U.S. Pat. No. 2,777,697), to No. 3,350,101), to Gibbs Bishop, et. al. (U.S. Patent et. al., (U.S. Pat. No. 1,484,390), and to Kimble (U.S. Pat. No. 3,658,344), all purport to teach various methods to achieve proper stance and swing in connection with the game of golf.

The Patent to Crossot purports to show a mechanical device which is a golf stance indicator, and is intended only to assist the player in aligning the stance relative to the ball. There is no feature of the Crossot device located at or near the ball, to assist the player in lining up the swing of the club or the flight path of the ball. Moreover, the Crossot devices requires a complex mechanical adjustment to allow the golfer to change stance for a different club selection.

The golf swing aid of Bishop et al. fails to align the golfer to the proper line of travel of the ball, but relies instead on a mechanical height indicator and elliptical path for the golf swing. The Bishop golf swing aid is deficient in that its complexity distracts the golfer from the fundamentals of golf, which are reinforced by the present invention. Moreover, because it has no removably attachable silhouettes for the feet, the Bishop golf swing aid fails to adequately assist the golfer in reproducing his stance relative to the ball.

Although the patent to Gibbs includes a figure showing the position of the ball, feet indicia for the Placement of the feet and a line indicating the direction of the flight of the ball, none of the feet indicia, position of the ball, nor the direction of the flight of the ball are movable. Indeed, the short-coming of the Gibbs chart is that the stance is fixed whereas, depending on the physique of the golfer and the nature of the golf shot and club selected, it is necessary to provide for different stances. These multiple stances may be facilitated by removably attachable foot placement indicators that are easily adjusted.

The device of Kimble is a complex mechanical device intended to be used in actual practice golf circumstances on a golf course, and is not designed for both indoor and outdoor use. Moreover, the complexity of the Kimble device makes it extremely difficult to use in actual golf practice and training situations. The portability and mechanical simplicity as well as the economics of the device of the present invention make it much more attractive for use in practice, training and instruction sessions.

All things considered, the prior art references do not provide the specific advantages of the present invention nor do any of the references properly address the objects sought to be achieved by the present invention. No prior art reference either singly, or in combination with any other prior art references, discloses the combination of removably attachable or adhesive foot silhouettes, removably attachable or adhesive golf ball image, a precision stance measurement grid comprising vertical and horizontal perception lines and swing path lines to insure the golfer's proper muscle alignment and to assist in teaching and training the golfer to use a consistent and reproducible stance and swing.

It is thus one object of the present invention to provide a device and methods to assist golfers in developing swings which are consistent from shot to shot based on a proper alignment of the muscles in the body arising out of the proper placement of the feet relative to the ball and relative to the target direction.

It is another object of the present invention to provide an improved golf device for teaching, training, and practice purposes which exemplifies proper foot positions relative to the golf ball and relative to the target direction.

Yet another object of the present invention is to provide an improved golfing device for teaching, training and practice purposes which contains removably adjustable or adhesive foot and golf ball silhouettes so that various players having different physiques or styles, or utilizing different clubs may intentionally and readily change the relative positions of the foot and golf ball silhouettes to achieve the desired ball flight direction.

Still another object of the present invention is to provide an easily transported and economic golf device which may be used in a variety of golf teaching, training and practice environments.

Still a further object of the Present invention is to provide a golf teaching, training, and practice device which may be utilized with or without a golf ball and with or without golf clubs.

Yet another object of the present invention is to provide methods for the proper development of muscles and alignment programming utilizing the golf teaching, training and practice device described herein.

SUMMARY OF THE INVENTION

A golf teaching, training and Practice device comprising in combination a mat, at least one removably attachable or adhesive foot silhouette which is attachable to said mat, a removably attachable or adhesive golf ball image, a precision stance placement grid on said mat comprising vertical and horizontal perception lines, and a swing path or target path on said mat. Optionally, the device may have an extended swing path or target path. Methods are also provided for proper golf teaching, training and practice utilizing muscle alignment programming comprising repetitious use of the device described herein.

DESCRIPTION OF THE DRAWING

FIG. 1 is an overhead view of the muscle alignment mat.

FIG. 2 is a side view of the muscle alignment mat in use.

DETAILED DESCRIPTION OF THE INVENTION

There are numerous uses of the muscle alignment mat of the present invention. First, it is contemplated that the mat may be used outdoors to assist in the practice of golf swings utilizing golf clubs and an actual golf ball placed at or near the removably attachable golf ball silhouette. Second, it is contemplated that such a muscle alignment practice mat may be used in the home either with or without golf clubs to practice the stance, address and swing. In this way, a golfer can practice his swing during the off-season without the necessity of going out of doors. Third, it is contemplated that the device of the present invention will be used in conjunction with a rigorous muscle alignment programming routine to develop proper golf muscles as well as a refined, reproducible golf stance, address, and swing.

Referring now with greater particularity to the drawings, the entirety of the golf teaching, training and practice aid is associated with golf mat (20) embodying the principles discussed herein. This golf mat comprises removably attachable or adhesive golf ball silhouette (7) and removably attachable or adhesive adjustable foot silhouettes (6). Also shown in FIG. 1 and associated with the golf mat device are the swing path or target line (1) with an associated swing path extension or target line extension (2) and a precision stance measurement grid (5) comprising horizontal perception lines (3) and vertical Perception lines (4).

The base mat is constructed on a rectangular or L-shaped sheet of any flexible material such as sheet rubber, sheet plastic, paper, outdoor carpeting, Velcro or any other material that is suitable. The particular type of flexible material is not important so long as it will accept and readily release the removably attachable foot silhouettes (6) and golf ball silhouette (7). Preferably, the mat is L-shaped with any elongated portion which includes the target line extension (2) as a narrow strip extending therefrom.

The purpose of the removably attachable, adjustable foot silhouettes (6) is to indicate the proper foot placement of the golfer for teaching, training and practicing. Thus, they are constructed of any suitable material (preferably a different color than the mat (20)) with a suitable adhesive or textured back, causing then to adhere to the golf mat stance measurement grid (5) of the mat (20) to indicate the proper placement of the golfer's feet. Moreover, the material of the foot silhouettes (6) is such that they may be removed and replaced numerous times on the grid (5) without losing their removably adhesive characteristic. Velcro is one such material.

The foot silhouettes (6) may also be made of a permanent adhesive or stick-on materials for more advanced players who might not normally make changes in their stance.

It is intended that for a given club, in a given lie, for a given golfer, one set of silhouettes in one position on the golf grid would be appropriate. It is further intended that, because the silhouettes adhere to the golf mat device until intentionally removed, such a stance would be reproducible time after time, so long as the removably adhesive adjustable foot silhouettes (6) remain placed or are replaced at the same location on the grid (5).

Although the foot silhouettes are removably attached to the muscle alignment mat, the positions of the feet could be recorded relative to the position of the ball for a given golfer club selection and lie when the removably attachable foot silhouettes (6) are in place. If moved from those positions, the foot silhouettes (6) then could be replaced later in their previous positions. Alternatively, multiple foot silhouettes could be employed for different golfers, club selection or intended shot. Of course, even a single foot silhouette is sufficient for the proper placement of the feet relative to the ball so long as the other foot is placed in a proper position relative to the first foot, say, for example, at about a shoulder's width apart during a drive.

One key feature of this invention is the reproducibility of body placement that can be achieved. Thus, an individual may decide to make additional appropriate markings on the grid where proper foot placement has been established for a given golf club and lie, that, unlike the silhouettes, would be immobile.

Of course, as one skilled in the art would appreciate, the foot silhouettes (6) can be placed relative to the ball silhouette (7) in any manner that the player desires. Indeed, to alter stance relative to the ball, the ball silhouette (7) might be moved. Ball silhouette (7) is preferably of a color different than the mat (20) and is made of the same or similar material to the foot silhouettes (6). In addition, if the use of the golf muscle alignment practice mat (20) is performed in the presence of a Professional golf instructor, that professional golf instructor may assist the golfer in selecting proper foot positions depending on club selection, lie and intended shot.

As shown in FIG. 1, another feature of the invention is swing path or target line (1), which extends parallel to the direction of the intended flight of the ball. This line is provided so that the player can visually determine the intended flight of the ball, as well as the intended direction of the travel of the club head immediately prior to and after contact with the ball. As can be seen from the FIG. 1, the swing path or target line (1) is also extended along path extension or target line extension (2). This extension (2) is intended so that the player or the player's aid or tutor can visually determine if the path of the ball is indeed along its intended direction. The player keeps his head and shoulders down during that portion of the full swing in which he can see the club head and path (1). This, in turn, is very effective in developing an efficient and proper golf swing.

The swing path or target line (1) as well as the swing path or target line extension (2) is shown as a straight line on the mat (20) in FIG. 1. The target path (1) and target path extension (2) is used to align the mat (20) with the ball and the ultimate target which may be anywhere from a few feet to several hundred yards away. In actual practice, as viewed by the golfer, the swing tends to be somewhat parabolic. However, during the short period of arc immediately before and immediately after the club face strikes the ball, the travel of the club face as viewed by the golfer appears to be a straight line. Moreover, the golfer should be instructed not to watch the club face during more than about 10 to about 30 degrees of swing arc during practice exercise only. To do so would distract the golfer to the detriment of the swing. It is intended that the golfer using this device would focus his vision on the removably attachable golf ball before and after the shot (or the golf ball itself). This stabilizes the lateral motion of the body's center of gravity. For all these reasons, the swing path or target path (1) as well as the swing path extension or target path extension (2) has been depicted as a straight line in the mat (20) of FIG. 1.

In actual use, it also is contemplated that one might view the practice swing along the swing path or target line (1) and follow-through along swing path or target line extension (2) viewing the top of the club face as the club swings along that path defined by lines (1) and (2).

The horizontal perception lines and the vertical perception lines are intended to be used in connection with foot silhouettes (6) during practice to determine the proper alignment of the feet relative to the ball and then, later, to align reproducibly the stance and address either by leaving the foot silhouettes in place or with appropriate marking on the mat (20) or even by recording foot placement.

A golfer practicing proper alignment and stance utilizing the device of the present invention is shown in FIG. 2. With golf club in hand, the golfer (8) stands with his feet at the positions of the appropriate removably attachable or adhesive foot silhouettes (6) within the stance measurement grid (5). The golfer stands with the club at address position (9) with the club face behind the ball image (7). Using the shoulders and arms together as a unit, with the left arm (for a right-handed golfer) acting as an extension of the club, the golfer draws the club back slowly to and through the first several feet of backswing position (10) with the club traveling along the swing path or target line (1). At the completion of the backswing, the golfer then drives the club through the swing arc, back through position (10) over the golf ball image (7) and to and through the first few feet of follow-through position (11), all the time maintaining the club along path (1) to path (2) while the golf club travels between positions (10) and (11).

As mentioned above, the muscle alignment device of the present invention may be used in many environments, with and without the use of clubs and balls. In fact, almost any stick or other similar device (e.g., baseball bat, meter stick, weighted club, and so forth) can be used in place of a club.

Some of the exemplary methods of using the muscle alignment device are more fully explained below. One principal method for using the mat is in connection with a muscle alignment programming routine. In this method the muscles are subconsciously trained to achieve a proper stance, address and swing.

MUSCLE ALIGNMENT PROGRAMMING

In general, bad aim usually causes a swing compensation that compounds swing errors. The reason for this compensation lies in the fact that the subconscious memory actually realizes that the body alignment is off in one direction or another. The subconscious memory causes an adjustment of swing which attempts to direct the ball toward the target. Most of the time the resulting shot is hit with a glancing blow or a swing that has lost leverage.

It is amazing the number of golfers who would "bet the ranch" that their personal alignment is relatively good or square to the target line, when in fact they may be ten or twenty degrees off line. Their conscious perception is telling them that they are lined correctly.

Ken Venturi once said, "a sound address system requires no special degree of strength or skill, or even good physical coordination, there is no reason why every golfer cannot have one." Ken Venturi, *The Venturi System*, pp. 15–16 (New York: Atheneum, 1983). Ben Hogen has said, "Obeying the basic stance . . . makes it appreciably easier for the golfer, as he goes into his backswing, to feel and control the muscles that should initiate the swing." Ben Hogan, *Ben Hogan's Five Lessons*, p. 43 (New York: A. J. Barnes, 1957)

Muscle alignment programming is designed to integrate conscious and subconscious perception of alignment and improve muscle memory for a precision stance, address and swing. With the proper address position memorized permanently through simple exercise and maintenance, the golfer will be able to concentrate on producing great shots. Jack Nicklaus has said, "I think it [setup] is the single most important maneuver in golf. It is the only aspect of the swing over which you have 100 percent control." Jack Nicklaus, *Golf My Way*, p. 77 (New York: Simon and Schuster 1974)

The following is a description of how to place the foot silhouettes (6) in their proper position on the muscle alignment mat (20) for each club selected.

The golfer should take the address position by first taking proper grip of the club. Set the club on the ground so that the clubface is aligned in a position perpendicular or square to the target, and as close to the ball silhouette (7) (or ball) as possible along the target path (1). The golfer should approach foot position from an "open position", or, in other words, by rotating the body to square with the target path (1) that is, (with shoulder line, the imaginary line connecting the shoulders, parallel to target path (1)), letting the forward shoulder come to square last.

Books by some masters of golf, including the Nicklaus, Hogan, Venturi books quoted above, are excellent home study guides to help formulate the fundamentals of a good address position. Some of the most popular address and alignment tips are:

- Feet should be no more than shoulder width apart.
- The hands should be fairly close to the body.
- Shoulders, hips and feet should be parallel to the target line (1).
- Upper body should be straight but slightly leaning forward from the hips so that arms can hang from the shoulder sockets.
- Keep elbows under, pointing toward your pockets.
- Knees should be pressed toward opposite toes to create a low center of gravity.
- When addressing the ball formulate a pre-shot routine that is fairly consistent.

Methods of utilizing the muscle alignment mat (20) in the muscle alignment program are described more fully below.

First, as described above, the optimum placement of the removably adhesive foot silhouettes is determined for each desired club, but preferably including the putter, wedge, five iron and driver. It is highly recommended that the golfer seek a Professional Golfer's Association Professional to help in the proper Placement of the foot silhouettes (6). Placements of the foot silhouettes (6) should reflect the exact positions of address with each club selected, preferably including putter, wedge, five-iron, and driver. Indeed multiple silhouettes may be used for varied stances with a single club, if desired.

The removably adhesive nature of the foot silhouettes (6) accommodates the personal aspects of address. The space between the feet, the distance from the ball, and open, closed or square alignment will change from golfer to golfer and from shot to shot.

Once the silhouettes of the proper stances have been placed on the muscle alignment device, address positions should be programmed in the subconscious memory of the golfer. Programming the subconscious memory takes from three to four weeks. During this period the golfer should have daily exercise periods using the muscle alignment mat (20). After four weeks, exercise on mat (20) should be performed at least every other day. It is believed that optimum muscle memory action will occur in approximately seven and one-half months. From this point on exercising twice a week or every four days should maintain maximum muscle memory.

The following examples are some of the possible examples of methods to program the muscles. They may be used singly or in combination according to the above-prescribed schedule.

Example I

Take the putter or other practice club. Assume the stance inside the proper foot silhouette positions (6) that have been attached in a proper personal position corresponding to the selected club. Count slowly from one to ten. Back out of the address position. Repeat this action three times.

Take a second, third and fourth club, in succession, and repeat this process from the beginning. Include preferably the wedge, five-iron, and driver.

Example II

Address the ball image (7) with the putter selected with the feet in proper foot silhouette (6) positions. While keeping the club grounded, march in place for a slow count to ten. Make sure to take small steps to ensure good balance. Repeat this exercise with three other clubs, including preferably the wedge, five-iron, and driver. (This little drill can be incorporated into an excellent pre-shot routine.)

Example III

Address the ball image (7) with the selected putter, with feet in proper foot silhouette (6) positions. Using the shoulders and arms together as a pendulum, move the putter slowly back, then across the ball image. Keep the putter head moving directly along the swing path or target line (1). Follow through along swing path or target line Extension (2). Perform ten such simulated putts.

Example IV

Place feet in proper placement for wedge in foot silhouettes (6). With the pitching wedge make a short (not longer than two feet) backswing. From this set-position turn your body slowly, moving the club head down the swing path or target line (1) using the entire body to reach your club as far down the swing path or target line extension (2) as possible without swaying toward the target. Make ten practice exercises and repeat this process from the beginning with at least two other clubs, preferably the five-iron, and driver.

While the foregoing examples are intended to demonstrate the muscle alignment programming mat and muscle alignment programming, these are not intended to be a limitation of the invention described herein. As one skilled in the art would understand, many variations, modifications and changes may be made to the invention described herein which do not depart from the spirit and scope of this invention. Specifically, but without limitation, the procedures for the use of the mat may be used with any club and the mat itself may be designed for a right-handed as well as a left-handed player.

I claim:

1. A golf teaching, training and practicing device, comprising in combination:

a. a mat comprising an essentially rectangular segment together with an elongated segment, wherein said rectangular segment consists of an imprinted (1) precision stance measurement grid on said mat comprising a multiplicity of vertical and horizontal perception lines, and (2) a swing path line, aligned with said elongated segment, and wherein said elongated segment consists of an imprinted swing path line extension in line with said imprinted swing path line and extending in the direction of the intended flight of a golf ball and being of a length sufficient to provide an aid for determining if a ball struck from the ball image location on said swing path line is moving along the intended ball flight direction;

b. at least one pair of removably attachable foot silhouettes, attachable to said essentially rectangular segment of said mat for the alignment of a golfer's feet;

c. a removably attachable golf ball image, which is removably attachable to said swing path.

* * * * *